US010371445B1

(12) United States Patent
Ripley

(10) Patent No.: US 10,371,445 B1
(45) Date of Patent: Aug. 6, 2019

(54) PASSIVE THERMAL CONTROL OF MICROWAVE FURNACE COMPONENTS

(71) Applicant: Consolidated Nuclear Security, LLC, Reston, VA (US)

(72) Inventor: Edward B. Ripley, Knoxville, TN (US)

(73) Assignee: Consolidated Nuclear Security, LLC, Oak Ridge, TN (US)

( * ) Notice: Subject to any disclaimer, the term of this patent is extended or adjusted under 35 U.S.C. 154(b) by 385 days.

(21) Appl. No.: 15/351,710

(22) Filed: Nov. 15, 2016

(51) Int. Cl.

| | |
|---|---|
| ***H05B 6/64*** | (2006.01) |
| ***H05B 6/70*** | (2006.01) |
| ***H05B 6/80*** | (2006.01) |
| ***F27B 14/06*** | (2006.01) |
| ***F27B 14/10*** | (2006.01) |
| ***F27B 14/20*** | (2006.01) |
| *F27D 99/00* | (2010.01) |

(52) U.S. Cl.
CPC ..... *F27B 14/06* (2013.01); *F27B 14/10* (2013.01); *F27B 14/20* (2013.01); *H05B 6/80* (2013.01); *F27D 2099/0028* (2013.01)

(58) Field of Classification Search
CPC ..... A61L 11/00; B09B 3/00; B09B 3/0075; H05B 6/782; H05B 6/802; H05B 2206/045; H05B 2206/046
USPC ..... 219/759, 756, 700, 634, 690, 680, 687, 219/688
See application file for complete search history.

(56) References Cited

U.S. PATENT DOCUMENTS

| | | | | |
|---|---|---|---|---|
| 2,871,529 | A | 2/1959 | Kilpatrick | |
| 4,664,618 | A | 5/1987 | Gitman | |
| 5,262,125 | A * | 11/1993 | Goodman | A61L 2/14 422/186 |
| 5,795,146 | A | 8/1998 | Orbeck | |
| 7,425,692 | B2 | 9/2008 | Orbeck et al. | |
| 8,440,157 | B2 | 5/2013 | Stoddard et al. | |
| 2001/0003338 | A1* | 6/2001 | Schulz | A61L 11/00 219/687 |
| 2006/0096977 | A1* | 5/2006 | Ripley | H05B 6/6494 219/690 |
| 2013/0213955 | A1* | 8/2013 | Jussel | H05B 6/80 219/634 |

* cited by examiner

*Primary Examiner* — Quang T Van
(74) *Attorney, Agent, or Firm* — Luedeka Neely Group, P.C.; Michael J. Renner, Esq.

(57) ABSTRACT

A microwave furnace includes a microwave casket having an inner surface forming an internal cavity. A heatable body, formed at least in part of a microwave susceptor material, is located in the internal cavity of the casket and heats in response to a microwave field. A thermal control system is provided, which includes a fluid flow path extending through the casket and has an inlet and an outlet formed in the microwave casket. A portion of the fluid flow path is adjacent the heatable body. The thermal control system flows a thermal transfer fluid through the fluid flow path via the inlet to absorb heat from the heatable body and to transfer the absorbed heat along the fluid flow path until the thermal transfer fluid exits the fluid flow path via the outlet.

30 Claims, 8 Drawing Sheets

SECOND FLUID SUPPLY
400
401

206
204
201
200
100
106A
114
114
106B
122
104
104
116B
112
150
118
110
116A
106
108
112
102
120
124
406
156
pump
603
306
303
302
301
pump
602
FIRST FLUID SUPPLY
300

PASSIVE THERMAL CONTROL OF MICROWAVE FURNACE COMPONENTS

GOVERNMENT RIGHTS

The U.S. Government has rights to this invention pursuant to contract number DE-NA0001942 between the United States Department of Energy and Consolidated Nuclear Security, LLC.

FIELD

The present disclosure relates to microwave furnace casting. In particular, the present disclosure relates to temperature control of microwave furnace casting components.

BACKGROUND

In heating and melting bulk metals using microwaves, three basic components are generally required: a multimode microwave chamber, a microwave-absorbing crucible, and a thermally insulating casket that is microwave transparent. A metal charge is placed in an open crucible, and the insulating casket is positioned to completely cover the open crucible. The casket and crucible assembly are then placed into a high-power multimode microwave chamber intended to uniformly heat the crucible to the desired temperature when microwave energy is applied to the chamber. The heat absorbed by the crucible from the microwave energy is then able to be transferred to the metal charge. The thermally insulating casket increases the energy efficiency of the microwave system by trapping the heat generated in the crucible. The metal charge in the crucible is quickly heated through radiation, conduction, and convection in the heated crucible. In this way, metal objects that could not be directly heated by microwave energy can be melted easily and efficiently.

To cast the molten metal into a final product, the crucible is often placed over a mold having a desired shape. The metal charge in the crucible is heated until molten. Upon melting, the metal is released and flows into the mold. In order to prevent the metal from solidifying or hardening upon contact with the mold, which could otherwise cause defects such as cavities to be formed in the final result, the mold is heated prior to the flow of metal from the crucible into the mold. Preferably, the metal is cooled and solidifies from the bottom of the mold to the top of the mold to reduce or prevent defects. To accomplish this, a directional temperature gradient is ideally formed in the mold and crucible assembly that promotes cooling of the molten metal from bottom to top. An example of an ideal temperature gradient is shown in FIG. 1. Specifically, a heatable body 106 is provided that includes a crucible 106A and a mold 106B, with hotter areas being represented by darker shading and cooler areas being represented by lighter shading. The crucible 106A has the darkest shading and, therefore, has the highest temperature. Progressing downwards, the temperature gradually falls and the bottom of the mold 106B is at the lowest temperature.

While the above-described directional temperature gradient is known in the prior art, obtaining and maintaining the desired temperature gradient can be difficult for several reasons. In particular, microwaves are preferentially absorbed by whatever absorbs them best. Thus, if two components that absorb microwaves are placed into the same microwave chamber, whichever component absorbs microwaves the best will typically heat much more than the other component. For example, it is possible that a very small component in the system might become superheated and the balance of the system could remain cold. Similarly, if there is arcing or a plasma formation in the chamber, the arc or plasma may absorb essentially all of the energy, which could damage equipment and could result in little energy being imparted to the crucible or mold.

In another example, as the temperature of certain materials (e.g., ceramics) that are used as susceptors in microwave casting increases, their ability to absorb microwaves may change. For purposes of the present disclosure, the word "suscept" means to absorb microwaves to convert the microwaves into heat. Additionally, a material's ability to convert the microwaves into heat will be described as a material's "susceptance level." A ceramic crucible is a type of susceptor because of its ability to absorb microwaves and to convert them to heat. The fact that susceptance levels of certain materials may be temperature dependent makes microwave heating of those materials (e.g., a ceramic crucible) somewhat unpredictable. There are several known scenarios for heating ceramics. First, the ceramic may be transparent to microwaves, which means it does not absorb microwaves and, therefore, does not heat up in the presence of microwaves. Second, the ceramic might have a greater susceptance level as the temperature of the ceramic increases, which in turn increases its capacity to further absorb microwaves. In other cases, the ceramic's ability to absorb microwaves might decrease as a function of temperature. In such a case, as the ceramic gets hotter, it becomes increasingly more difficult to heat. When using this type of ceramic, it might establish a plateau where it does not get any hotter or it might suddenly drop in temperature once a critical temperature is reached. In still other cases, the ceramic does not start to absorb microwave energy until a critical temperature has been reached. Upon reaching that critical temperature, the ceramic's ability to absorb microwave energy increases as the temperature increases. Lastly, the ceramic may heat in a linear fashion with no change in absorption as a function of temperature.

A problem with microwave casting is that, due to the possible preferential heating of certain components and possible changing physical properties of those components during the heating process, certain portions of the mold and crucible assembly may become too hot or remain too cold. Pouring molten metal under these conditions may be impossible or may result in a less than ideal resulting product.

Correcting the problems using traditional methods are time consuming and can also result in a less than ideal resulting product. For example, as illustrated in FIG. 2, if the crucible 106A is too hot and the mold 106B is too cold, one method of correction is to cut back microwave power. Often, to prevent overheating of the crucible 106A, the power is reduced by 50-75%. This allows the mold to be heated by conduction from the crucible 106A prior to the flow of the molten metal from the crucible 106A to the mold. However, this power reduction significantly increases hold times to heat the mold and, thus, slows the heating process. Multiple rounds of increasing and reducing microwave power may be required to obtain a suitable temperature profile for the crucible and mold, which wastes time and energy. In another example, as illustrated in FIG. 3, if the mold is too hot and the crucible 106A is too cold, a method of correction is to simply pour the metal into the mold as soon as the metal reaches a suitable temperature in the crucible 106A, which may result in defects in the end product. Alternatively, the pour process can be aborted. Again, this is a waste of energy, time, and resources.

What is needed, therefore, is a system and method for controlling the heating and cooling of microwave furnace components that is more efficient and consistent, resulting in a higher quality final product while also reducing energy requirements.

SUMMARY

According to one embodiment of the disclosure, a microwave furnace is provided. The microwave furnace includes a microwave casket having an inner surface forming an internal cavity. A heatable body is disposed in the internal cavity of the casket, which is formed at least in part of a microwave susceptor material that is operable to heat in response to a microwave field. In certain embodiments, the heatable body comprises a crucible and a mold. The furnace further includes a thermal control system including a fluid flow path extending through the casket and having an inlet and an outlet formed in the microwave casket. At least a portion of the fluid flow path is disposed adjacent at least a portion of the heatable body. The thermal control system is operable to flow a thermal transfer fluid through the fluid flow path via the inlet to absorb heat from the heatable body and to transfer the absorbed heat along the fluid flow path until the thermal transfer fluid exits the fluid flow path via the outlet.

In certain embodiments, the furnace also includes a microwave chamber wall forming an enclosed microwave chamber, wherein the microwave casket and heatable body are disposed within the microwave chamber. Also, a fluid supply is provided for supplying the thermal transfer fluid to the microwave chamber. A first fluid pipe, located outside of the microwave chamber and having an end attached to the fluid supply and an opposite end in fluid communication with the microwave chamber, carries the thermal transfer fluid from the fluid supply to the microwave chamber. Also, a second fluid pipe, located outside of the microwave chamber and having an end in fluid communication with the microwave chamber and a fluid exhaust located at an opposite end of the second fluid pipe, carries at least a portion of the thermal transfer fluid away from the microwave chamber. In response to a pressure differential between pressure inside the microwave chamber and pressure outside of the microwave chamber created by opening the first fluid pipe and the second fluid pipe, the thermal transfer fluid provided by the fluid supply via the first fluid pipe flows into the casket, flows along the flow path, flows out of the casket, and flows out of the microwave chamber via the second pipe.

The furnace may also include a pump disposed within the microwave chamber proximate the inlet of the flow path, where the pump is configured to intake and then propel thermal transfer fluid located within the microwave chamber through the flow path and to cause at least a portion of the fluid exiting the flow path to be re-circulated within the microwave chamber back to the pump and then propelled through the flow path.

In other embodiments, the opposite end of the second fluid pipe is connected to the fluid supply such that fluid flowing through the flow path and exiting the microwave chamber via the second fluid pipe re-circulates back to the fluid supply. The microwave furnace further includes a pump disposed in at least one of the first and second fluid pipes that causes the thermal transfer fluid to be propelled away from the fluid supply and into the microwave chamber via the first pipe, along the flow path, and out of the chamber and back to the fluid supply via the second pipe.

In certain embodiments, the flow path is arranged such that heat absorbed from a first portion of the heatable body by the thermal transfer fluid is used to heat a second portion of the heatable body as the thermal transfer fluid flows along the flow path. The first portion of the heatable body may have a first susceptance level and the second portion of the heatable body may have a second susceptance level.

Sometimes the inlet is disposed in a top plate of the casket above the heatable body and the outlet is disposed in a bottom plate of the casket below the heatable body. At other times, the outlet is disposed in a top plate of the casket above the heatable body and the inlet is disposed in a bottom plate of the casket below the heatable body.

In some embodiments, the heatable body is placed on top of a base plate of the casket and the fluid flow path includes a fluid directing structure configured for directing the transfer fluid flowing across a surface of the base plate beneath at least a portion of the heatable body. The fluid directing structure may be selected from the group consisting of: one or more channels formed in the base plate and one or more ridges formed on the base plate. The fluid directing structure may extend radially outwards from a center of the base plate located directly beneath the heatable body.

In some embodiments, the fluid flow path comprises a void space disposed between the inner surface of the microwave casket and an outer surface of the heatable body.

BRIEF DESCRIPTION OF THE DRAWINGS

Further advantages of the disclosure are apparent by reference to the detailed description when considered in conjunction with the figures, which are not to scale so as to more clearly show the details, wherein the reference numbers indicate like elements throughout the several views, and wherein.

DETAILED DESCRIPTION

Figure 1:
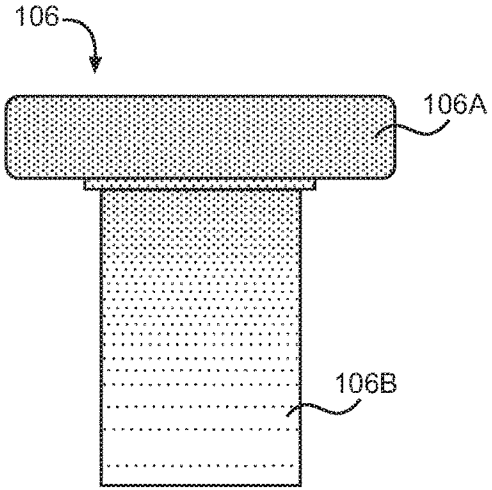
FIG. 1 is a side elevation view of a mold and crucible stack assembly illustrating an ideal pre-pour temperature gradient where the cast part solidifies and cools from the bottom to the top of the casting stack.

With reference now to FIGS. 4-8, a microwave furnace 100 having a thermal control system is disclosed according to one embodiment of the present disclosure. The furnace 100 includes generally a chamber wall 200 defining a microwave chamber 201; an insulating casket 102, located within the microwave chamber, having an inner surface 104 forming an internal cavity inside the casket; a heatable body 106 disposed in the internal cavity of the casket 102; and a fluid flow path 108 that extends through the casket and adjacent at least a portion of the heatable body. One or more fluid supplies, including a first fluid supply 300 and a second fluid supply 400, are provided outside of the microwave chamber 201 for providing one or more types of thermal transfer fluids to the microwave chamber. For purposes of the present disclosure, the term "thermal transfer fluid" refers to a gas or liquid that is capable of absorbing and releasing heat via convection. Thermal transfer fluids quickly and readily absorb heat via convection and are preferably in the form of a gas. In preferred embodiments, the thermal transfer fluid comprises argon gas, nitrogen gas or helium gas. However, the thermal transfer fluid may be other fluids or gases, including chamber atmosphere.

The casket 102 may be formed in various shapes and sizes in order to accommodate the heatable body 106 that is to be placed inside of it. In certain embodiments, the casket 102 includes a base plate 110, surrounding wall 120, a top plate 122, and one or more inserts 124. The inserts 124 may be removed and exchanged to accommodate different shaped or sized heatable bodies 106. The surrounding wall 120 is located adjacent the sides of base plate 110 while inserts 124 are located within the surrounding wall 120 to form a suitable internal cavity for the heatable body 106. The heatable body 106 is placed within the internal cavity and the top plate 122 encloses the heatable body within the casket 102. The casket 102 is preferably at least partially formed by a microwave transparent insulation, which does not absorb microwaves. The casket 102 is provided with one or more inlets 116A, 116B and outlets 118 in communication with a fluid flow path 108 to allow the fluid to flow through the casket 102 and along the flow path 108 in different directions or along different paths. While the casket may be provided with only one inlet and one outlet, one reason for having more than one inlet is to enable fluid to flow through a partially obstructed flow path 108. For example, the centrally-located inlet 116B shown in FIG. 4 may be obscured by a pour mechanism (not shown). In those instances, the fluid may be introduced into the flow path 108 via the offset inlet 116A. The fluid flow direction is reversed in FIG. 8. In that scenario, if the centrally-located inlet 116B is blocked, the fluid would flow out via the offset inlet 116A. As described below, the inlets 116A, 116B and the outlet 118 may each be utilized as either inlets or outlets.

The heatable body 106 within the casket 102 includes a crucible 106A for holding a metal charge and a mold 106B in fluid communication with the crucible 106A for forming a final product. The heatable body 106 is at least partially formed using a microwave susceptor that is configured to heat in response to a microwave field. For example, a first portion of the heatable body 106, such as the crucible 106A, may be formed from a material having a first susceptance level. This material may be selected for its ability to heat in response to microwaves. Ceramic crucibles are suitable for this purpose. At the same time, a second portion of the heatable body 106, such as the mold 106B, may be formed from a material having a second susceptance level that is typically less than the first susceptance level of the crucible 106A. This material may be selected based on physical properties that make the material well-suited as a mold 106B, such as graphite. When the heatable body 106 is placed into the casket 102 and a microwave field is generated, the susceptor portions of both the crucible 106A and mold 106B become heated and that heat is at least partially trapped within the insulated casket 102. As the crucible 106A is typically formed from a susceptor material having a greater susceptance level than the susceptor material of the mold 106B, the crucible 106A will typically be heated at a greater rate and ultimately greater temperature than the mold 106B.

As discussed above, the heatable body 106 and the casket 102 are enclosed within the microwave chamber 201 by the chamber wall 200. Pipes are routed from the first and second fluid supplies 300, 400, through the chamber wall 200, and into the microwave chamber 201 for the purpose of carrying fluids from those supplies to the chamber. Other pipes may be included to provide exhausts out of the microwave chamber 201. The pipes include valves that are used to open and to close fluid paths to and away from the microwave chamber 201, the insulating casket 102 and the heatable body 106. The pipes, valves and flow path 108 enable fluid that has been supplied by the fluid supplies 300, 400 to flow into the microwave chamber 201 and flow through the flow path past the heatable body 106 for the purpose of providing thermal control for the furnace 100. The flow direction of the fluid through the chamber 201, including along the flow path 108, is determined by opening or closing the valves and also by the existence of a pressure differential inside the microwave chamber 201 versus outside the chamber. When the fluid passes by the heatable body 106, the fluid may be used to transport heat to or away from portions of the heatable body in order to heat or cool those portions.

While the fluid flow path 108 preferably extends through the casket 102 along at least one exterior side of the heatable body 106 as shown, the fluid flow path 108 may, alternately, be disposed adjacent only desired portions of the heatable body 106 depending on which portions of the heatable body 106 are desired to be heated or cooled. However, while some portions of the heatable body 106 may be unexposed to the fluid flow path 108 in order to accommodate design, size, safety, and other considerations, maximizing the surface area of the heatable body 106 that is exposed to the fluid flow path 108 will improve heat transfer efficiency and is generally desirable.

Figure 4:
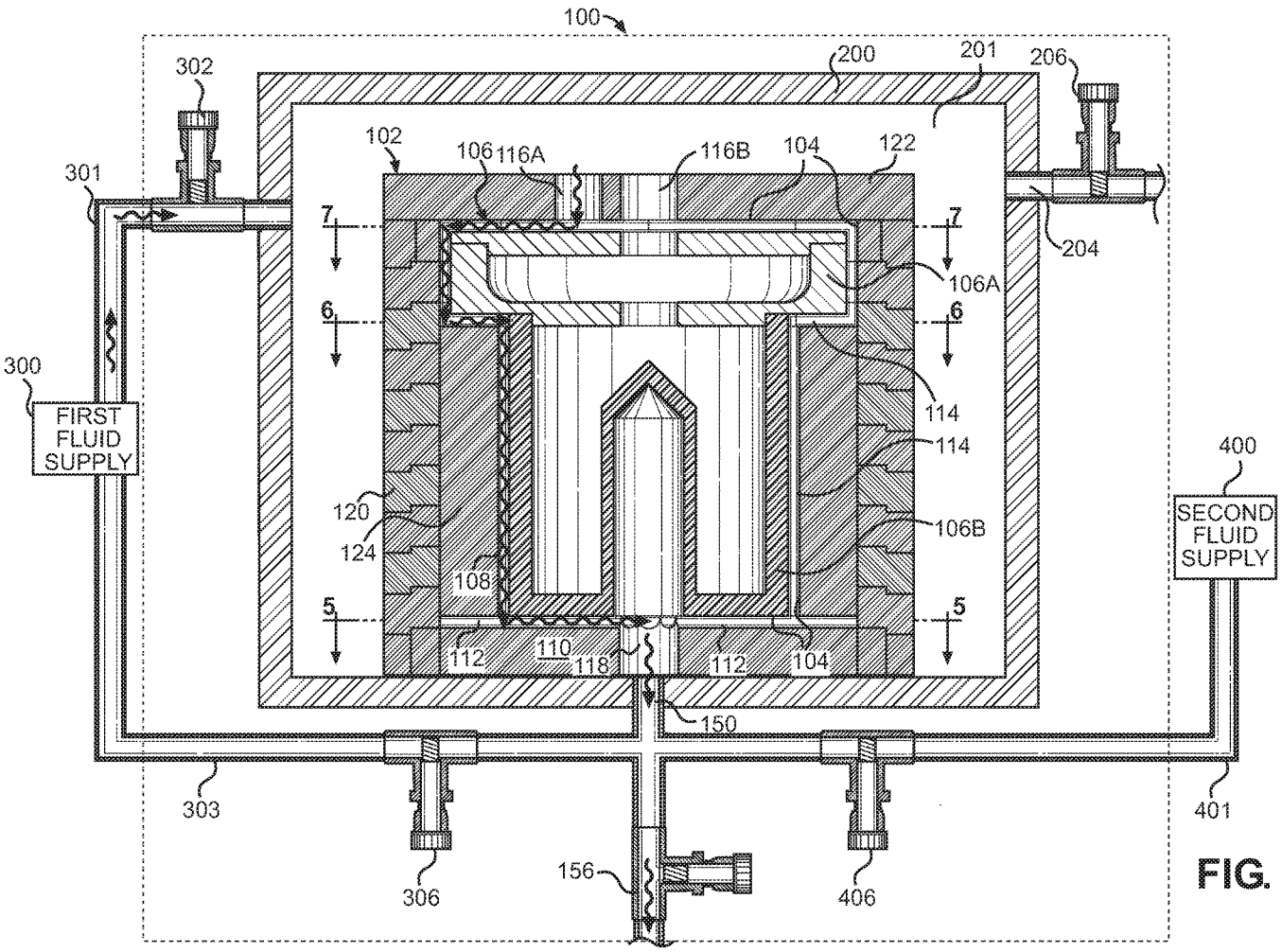
FIG. 4 is a side elevation view illustrating a microwave casket located within a microwave chamber and equipped with a thermal control system according to an embodiment of the present disclosure.

Referring specifically to FIG. 4, the thermal control system is used to transfer heat from the crucible 106A to the mold 106B. According to this embodiment, the thermal transfer fluid originates from the first fluid supply 300 and is carried to the microwave chamber 201 via pipe 301 by opening valves 302 and 156 and closing valves 206, 306 and 406. The fluid supplied via pipe 301 causes the pressure inside of the microwave chamber 201 to become higher than the pressure outside of the microwave chamber, thereby creating a pressure differential. Thus, opening valve 156 causes the thermal transfer fluid introduced to the microwave chamber 201 to enter the casket via inlet 116A or 116B and to then flow along the flow path 108. As shown, the flow path 108 goes around the crucible 106A and down the mold 106B before the thermal transfer fluid exits out of the casket via outlet 118, into pipe 150, and out via the open valve 156. The fluid will continue to flow into the chamber 201 from the first fluid supply 300 and along the above-described path until the pressure differential is eliminated. As noted above, the flow direction illustrated in FIG. 4 may be used for absorbing heat away from the crucible 106A to cool the crucible and transferring the absorbed heat to the mold 106B as the fluid flows past the crucible 106A and then mold 106B.

Figure 8:
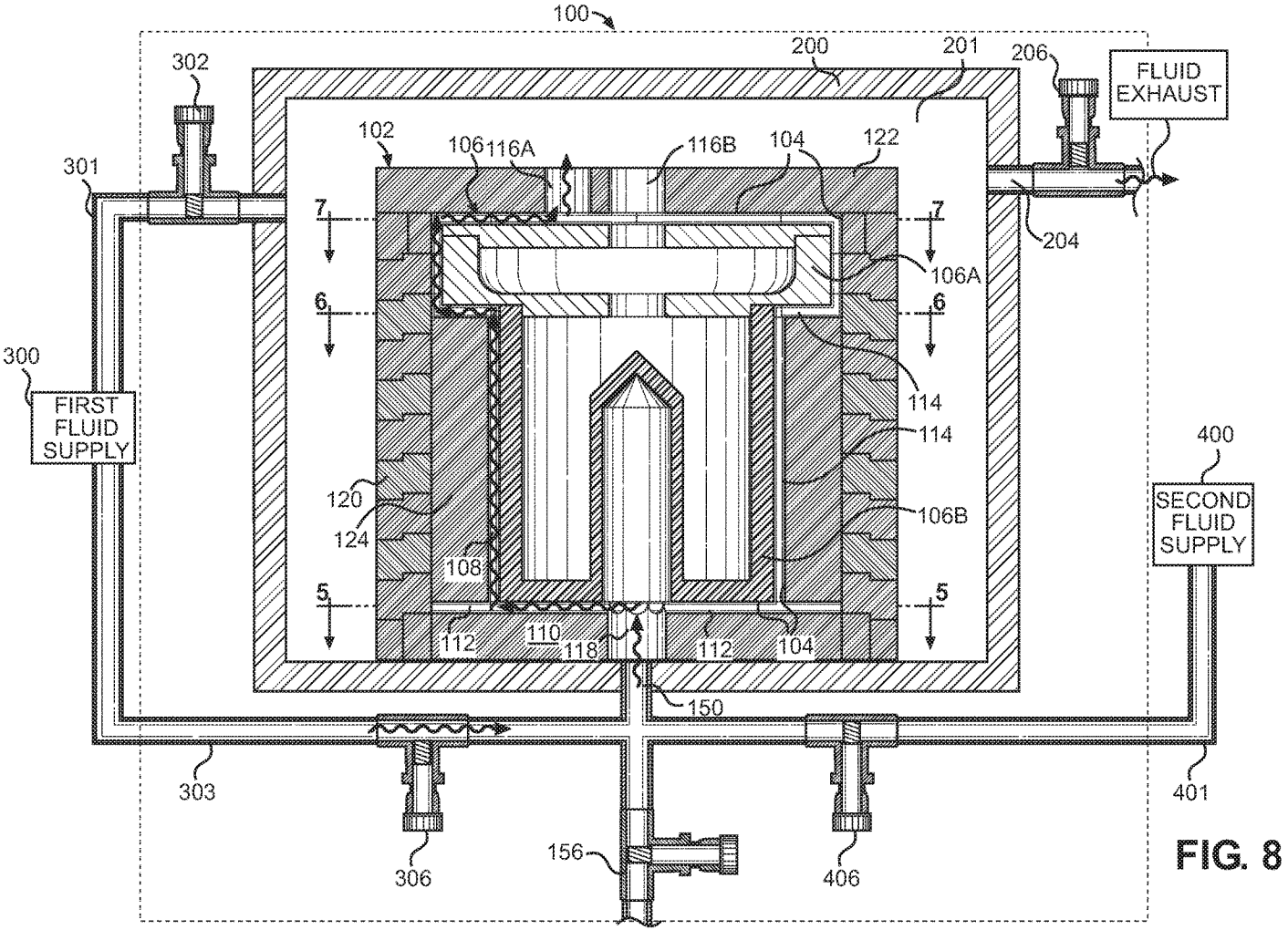
FIG. 8 is a side elevation view illustrating a reversed fluid flow path extending through a microwave casket located within a microwave chamber according to an alternative embodiment of the present disclosure.

Referring to FIG. 8, the thermal control system of the embodiment of FIG. 4 may alternately be used to transfer heat from the mold 106B to the crucible 106A by reversing the fluid flow path 108 of FIG. 4. According to this embodiment, a fluid supplied by the first fluid supply 300 may be carried to the casket 102 via pipe 303 by opening valves 306 and 206 while closing valves 302, 406 and 156. Once those valves are closed, the thermal transfer fluid flows along pipe 303, upwards through pipe 150 and then enters the casket 102 via outlet 118 (acting as an inlet in this case). The fluid then continues to flow upwards through the casket 102 along the flow path 108, where it first passes the mold 106B and then passes the crucible 106A. The fluid then flows out of the casket 102 via the one of the inlets 116A, 116B (which are acting as outlets in this embodiment) into the microwave chamber 201. As the fluid flows into the microwave chamber 201, the pressure within the chamber is increased so that it is higher than the pressure outside of the chamber. Due to this pressure differential, the fluid flows out of the chamber 201 via pipe 204. The fluid will continue to flow along the above-described path until the pressure differential is eliminated. The flow direction illustrated in FIG. 8 may be used for absorbing heat away from the mold 106B to cool the mold and transferring the heat to the crucible 106A as the fluid flows past the mold 106B and then crucible 106A.

Similarly, with continued reference to FIG. 8, in a third embodiment, the thermal transfer fluid of the fluid flow path 108 may be supplied by the second fluid supply 400 via pipe 401 instead of the first fluid supply 300 by opening valves 406 and 206 and closing valves 302, 306 and 156. The thermal transfer fluid from the second fluid supply 400 may then flow upwards along the flow path 108 and out of the chamber through pipe 204.

In a fourth embodiment, valves 306 and 406 are opened and thermal transfer fluid is supplied by both the first fluid supply 300, via pipe 303, and the second fluid supply 400, via pipe 401. The two fluids meet and mix at pipe 150 and then flow upwards through the flow path 108 as a combined fluid. For example, the first fluid supply 300 might provide $H_2$ gas, the second fluid supply 400 might provide Ar gas, and the combined $H_2$-Ar gas flows through the flow path 108 to provide a reducing atmosphere.

In a fifth embodiment using the configuration of FIG. 4, the flow path 108 may be bypassed entirely at times such that the heat redistribution function may be utilized on an as-needed basis. With reference to FIG. 4, fluid may be continually supplied to the chamber 201 from the first fluid supply via pipe 301 and opening valves 302 and 206 while bypassing the casket 102 and the flow path 108 by closing the valves below the casket, namely valve 156, 306 and 406. This will cause the fluid entering the chamber 201 to flow out via pipe 204 without flowing along the flow path 108. However, if the heat redistribution function is later desired, valve 206 may be closed and valve 156 may be opened such that the fluid will then flow along the flow path 108 as illustrated in FIG. 4.

Certain embodiments above describe an open system in which the thermal transfer fluid is exhausted out of the thermal transfer system after traveling through the fluid flow path 108. In other embodiments, a closed loop system is used. In a closed system, the thermal transfer fluid is not vented out of the system. A closed system may be created by providing a microwave chamber that has no openings (e.g., pipes) for carrying fluid out of the chamber. A closed system may also be created by closing pipes connected to the chamber 201 in order to trap fluids inside the chamber and prevent them from leaking. A closed system may also be created by re-circulating the thermal transfer fluid through pipes connected to the microwave chamber. One reason to utilize a closed system, where the thermal transfer fluid is not be exhausted out, is where a rare or expensive thermal transfer fluid is used. By using a closed system and re-using the same thermal transfer fluid repeatedly, material costs are reduced. Another reason is if the thermal transfer fluid should not be vented out for environmental reasons (e.g., prevent toxic or dangerous fluids from entering the atmosphere).

Figure 9:
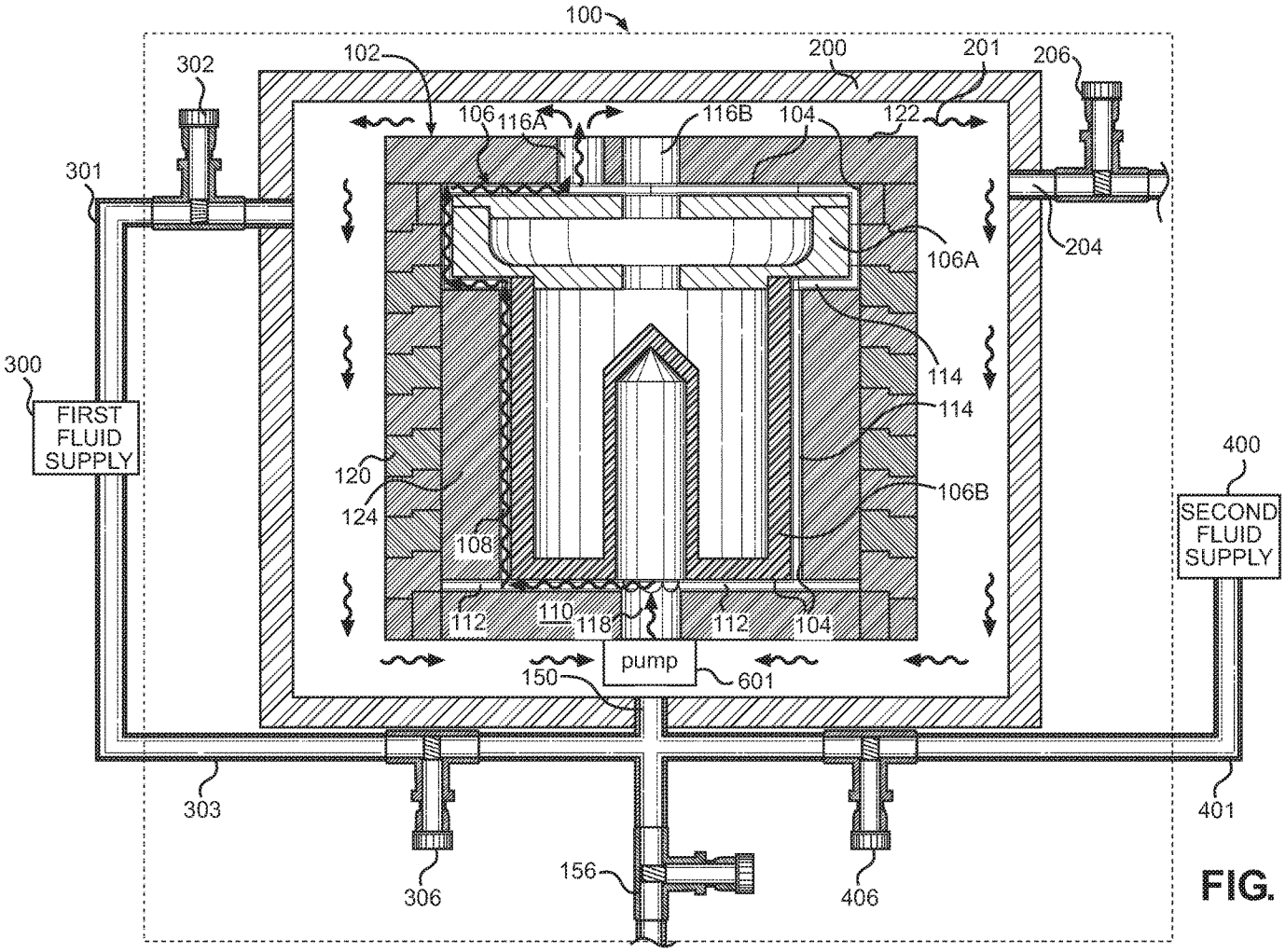
FIG. 9 is a side elevation view illustrating a furnace equipped with a thermal control system including a pump for re-circulating a thermal transfer fluid through a microwave casket and within a microwave chamber.

One example of a closed system is depicted in FIG. 9, where valves 156, 206, 302, 306, and 406 are shut in order to prevent fluids located within the chamber 201 from leaking out. Closing the valves prevents a pressure differential from being generated within the chamber in the manner discussed above. Therefore, a pump 601 is provided within the microwave chamber 201 for the purpose forcing fluid through the flow path 108 and for re-circulating thermal transfer fluid within the chamber. For purposes of the present disclosure, the term "pump" refers to pumps, including positive displacement pumps and non-positive displacement pumps; fans; blowers; and any other device capable of pushing or pulling a fluid.

The pump 601 is located proximate the outlet 118 (acting as the inlet in this particular case) of the flow path 108. The pump 601 intakes thermal transfer fluid located in the microwave chamber 201 and then propels the thermal transfer fluid through the flow path 108. Due to the force imparted by the pump 601 to the fluid, the fluid passes into the casket 102 via the outlet 118, flows along the flow path 108, and then flows out of the casket via inlet 116A or inlet 116B. After exiting the casket 102, the pump 601 draws at least a portion of the fluid through the microwave chamber 201 and then back to the pump 601. The pump 601 then propels the fluid back into the flow path 108. In an alternative embodiment, the pump 601 may be reversed so that the fluid enters the casket 102 via inlet 116A or 116B and then exits the casket via outlet 118.

The closed loop process described above may be used to absorb heat away from the heatable body 106 as it flows along the flow path 108. The heat that is absorbed may be carried to other portions of the heatable body 106 in order to redistribute the heat. In combination, these processes may be used to ensure a proper temperature gradient in the heatable body 106 prior to pouring molten metal from the crucible 106A into the mold 106B.

Additionally, the fluid may be used to cool the heatable body 106 as a whole. This may be useful, for example, after the pouring process is completed to quickly cool or quench a newly cast part so that it may be handled. The pump 601 causes cool fluid (at temperature T1) to be flowed into the casket 102 and past the hot heatable body 106. As the fluid flows past the heatable body 106, heat is absorbed away from the heatable body, which cools the heatable body and heats the fluid. The fluid then flows out of the casket 102 and carries the heat with it. When the fluid exits the casket 102 it is at temperature T2, which is higher than temperature T1. The heat carried by the fluid may be dissipated to the chamber 201 or to the chamber wall 200 as the fluid is circulated within the chamber. The fluid is then re-circulated back to the pump 601 and the process is repeated. The fluid is at temperature T3 when it is re-circulated back to the pump 601 prior to passing through the heatable body 106 again.

Preferably, the chamber 201 and chamber wall 200 are sufficiently large enough and massive enough that a majority of the heat in the fluid is lost before the fluid is re-circulated through the pump. Thus, in preferred embodiments, T3 is lower than T2 and, more preferentially, T3 is equal to or approximately equal to T1.

If the temperature of the thermal transfer fluid is equal to or greater than the temperature of the heatable body 106, it will be unable to draw heat from the heatable body. Thus, while the system described above was entirely closed, it may be desirable to have a semi-open system, where fresh, cool thermal transfer fluid is introduced into the chamber 201. This may be required if the heat carried by the thermal transfer fluid trapped within the chamber 201 is not sufficiently dissipated to the chamber or chamber wall 200. With continued reference to FIG. 9, fluid may be provided to the chamber 201 from the first fluid supply 300 via pipe 301 by opening valve 302 or via pipe 303 by opening valve 306.

In further reference to FIG. 9, a partially close (and partially open) system may be achieved by slightly opening valve 206, which will cause certain fluids to be vented out via pipe 204. This may be used to maintain a consistent, positive pressure inside the chamber 201, which is typically desired in microwave operations, and to off-gas certain fluids. For example, undesired byproducts, such as CO gas, may be vented out through pipe 204. Often the undesirable byproducts are lighter than the fluid supplied by the fluid supplies. For this reason, the undesirable byproducts tend to float above the thermal transfer fluid. Placing the vent pipe 204 at the top of the chamber 201 allows the byproducts to be vented out. Alternatively, if the byproduct is heavier than the supplied fluid, a vent pipe with a valve (not shown) may be provided at the bottom of the chamber 201. In that case, the byproduct would lie beneath the supplied fluid and could be vented out through the vent at the bottom of the chamber 201 by opening the valve. Optionally, valve 206 and the valve in the vent pipe located at the bottom of the chamber could be open concurrently.

Figure 10:
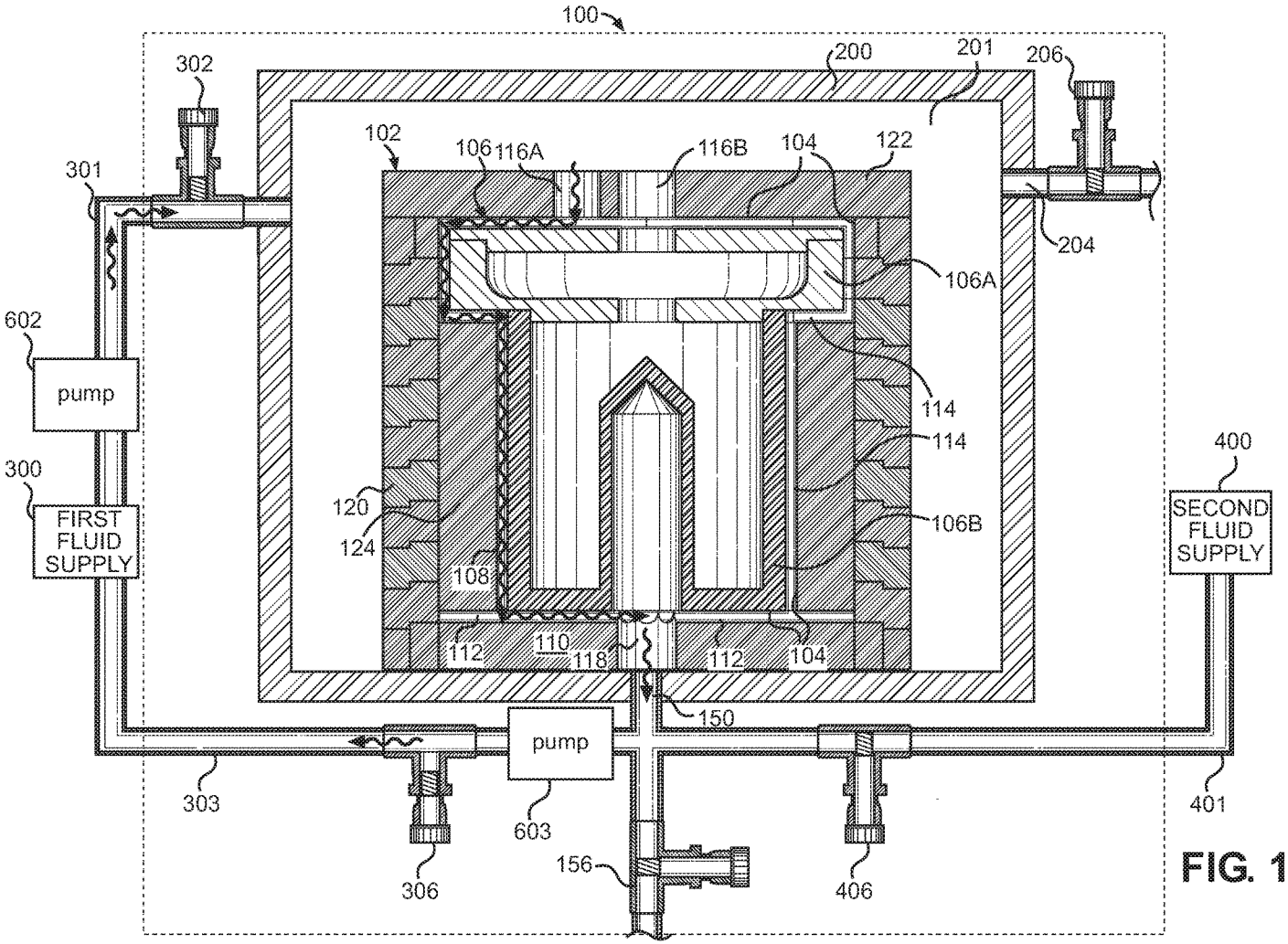
FIG. 10 is a side elevation view illustrating a furnace equipped with a thermal control system including pumps for re-circulating a thermal transfer fluid through a microwave casket and back to a fluid supply through pipes attached to a microwave chamber.

Another example of a closed system is depicted in FIG. 10, where the thermal transfer fluid is circulated outside of the microwave furnace 100 back to the fluid supply 300 via pipes 301 and 303 by opening valves 302 and 306. The system is closed by shutting valves 156, 206, and 406 to prevent fluid from leaking outside of the desired path. If the fluid were simply allowed to flow out of the fluid supply 300, through the flow path 108 and chamber 201, and back to the fluid supply, an equilibrium state would be achieved. Once equilibrium was achieved, the fluid would cease flowing. Thus, a pump is provided in pipe 301, pipe 303, or both to propel the fluid through the system. In this case, a pump 602 is located on pipe 301 and propels the fluid traveling to the chamber 201 into the chamber. Additionally, a second pump 603 is located on pipe 303 and propels fluid leaving the chamber 201 towards the fluid supply 300. This type of closed system may be used without a chamber 201 and chamber wall 200 in non-microwave heating methods. In that case, pipe 301 is mounted directly to one of the inlets 116A, 116B and pipe 303 is mounted directly to the outlet 118.

In general, controlling the direction of the fluid through the fluid flow path 108 is accomplished by opening and closing appropriate valves of the thermal control system such that fluid will move from an area of high pressure in the microwave chamber 201 through the fluid flow path 108 to an area of lower pressure. When the thermal transfer fluid is flowed through the fluid flow path 108, the thermal transfer fluid carries heat away from a selected portion or portions of the heatable body 106.

Figure 2:
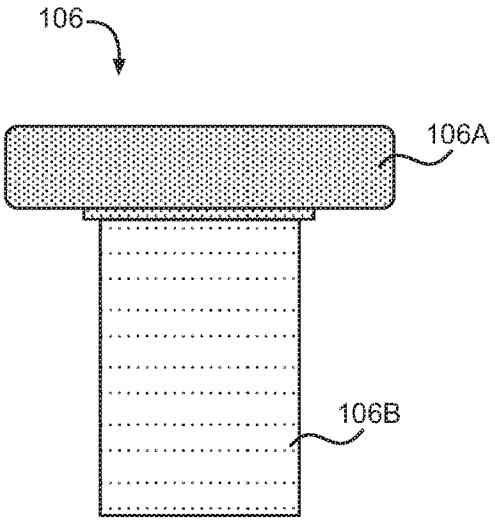
FIG. 2 is a side elevation view of a mold and crucible stack assembly illustrating an instance where the crucible is too hot and the fluid flow through the stack assembly is directed from top to bottom.

As an example, suppose the first portion of the heatable body 106 is a ceramic crucible 106A and the second portion of the heatable body is a graphite mold 106B. When placed into the microwave, the crucible 106A would likely heat very quickly in response to the microwaves compared to the mold 106B. If the crucible 106A became too hot and the mold 106B was too cold, as shown in FIG. 2, the control system described herein would allow the temperature of the crucible 106A and the mold 106B to be modified quickly to obtain the ideal pre-pour temperature gradient shown in FIG. 1. Flowing a thermal transfer fluid from the top of the heatable body 106, over its outer surface, and to its bottom would enable heat to be transferred from the crucible 106A to the mold 106B quickly. The fluid would have the most heat immediately after flowing past the crucible 106A. For this reason, the top of the mold 106B would receive the most heat. As the fluid continues to flow downward, it would continually lose heat and the bottom of the mold 106B would receive the least amount of heat and would warm the least. Thus, this would create the ideal temperature gradient and would speed the heating of the mold without increasing power usage or lengthening hold times.

Figure 3:
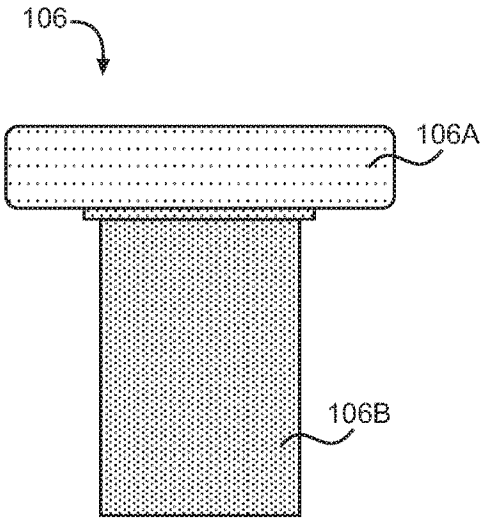
FIG. 3 is a side elevation view of a mold and crucible stack assembly illustrating an instance where the mold is too hot and the fluid flow through the stack assembly is directed from bottom to top.

In another example, this system may be used to correct a scenario where the graphite mold has become too hot or if it were to reach a homogeneous or uniform temperature, as illustrated in FIG. 3. In that case, some of the excess heat can be removed from the mold by allowing a natural chimney effect to occur where heat rises from the mold 106B along the created fluid flow path 108 to the crucible 106A. On the other hand, as shown in FIG. 8, that cooling process may be accelerated by flowing a thermal transfer fluid upwards from the bottom of the stack and out of the top of the stack. The largest amount of heat would be absorbed from the bottom of the mold, so the bottom of the mold would have the greatest change in temperature. Less heat would be absorbed as the fluid flows upwards. The mold would continue to cool relative to the crucible as long as the fluid flow is maintained. Sustaining and possibly throttling the fluid flow would enable the correct temperature gradient to be achieved. Additionally, after a casting is made, a larger volume of fluid can be directed through the base plate and allowed to flow upwards through the casket. Preferably, a forced stream of fluid would be utilized. This would enable the casket to be quickly cooled.

While one configuration of the fluid flow path 108 is depicted in FIGS. 4 and 8, it should be understood that other configurations are possible, and the portion(s) of the heatable body 106 in which heat is carried away generally depends on the particular configuration of the fluid flow path 108 with respect to the heatable body 106 and/or the direction in which the thermal transfer fluid is directed through the fluid flow path 108. Further, while the configuration of FIGS. 4 and 8 depict a fluid flow path 108 in which heat is carried away from one portion of the heatable body 106 to another portion of the heatable body 106, the fluid flow path 108 may also be configured such that the thermal transfer fluid flows past a much smaller portion of the heatable body 106 and immediately vented out of the chamber 200. According to this configuration, the temperature of only the portion of the heatable body 106 that is along the path of the fluid flow path 108 is substantially changed.

In preferred embodiments, and as shown in FIGS. 4 and 8, the thermal control system includes multiple fluid supplies such that different fluids, such as fluids with different compositions, flow rates, starting temperatures, etc., may be transferred through the fluid flow path depending on application preferences. For example, a first fluid, such as argon, may be provided from the first fluid supply 300 and a second fluid, different from the first fluid, such as helium, may be provided from the second fluid supply 400. In another example, the first fluid may comprise a first volumetric flow rate and the second fluid may comprise a second volumetric flow rate that is higher or lower than the first volumetric flow rate. The different flow rates and different fluid compositions may be useful for increasing or decreasing the rate of temperature change at a selected portion or portions of heatable body 106. Thus, the first fluid may provide a first rate of temperature change and the second fluid provided may provide a second (higher or lower) rate of temperature change.

While the thermal transfer fluid is preferably a pressurized fluid provided by external fluid supplies 300, 400, the thermal transfer fluid in alternate embodiments may simply be the chamber atmosphere gas. If a sufficient pressure differential exists, simply opening valve 156 or 206 may be sufficient to vent the chamber atmosphere through the flow path 108 and out via pipe 150 or pipe 204. In other cases, a sufficient pressure differential may be provided by drawing a vacuum or negative pressure on the microwave chamber 201, such as by providing suction to pipe 150 or pipe 204. This would also cause chamber atmosphere gas to be drawn through the flow path 108. Thus, according to this embodiment, the external fluid supplies 300, 400 and associated pipes 301, 303, 401 and valves 302, 306, 406 may potentially be omitted.

The flow path 108 may be fully or partially formed by fluid directing structures disposed within the casket 102. As depicted in FIGS. 4 and 8, the fluid direction structure may be in the form of a void space 114 that is created between the exterior of the heatable body 106 and an inner surface of the base plate 110, top plate 122, the surrounding wall 120, or inserts 124. The void space 114 is formed by sizing the furnace components such that the internal cavity formed within the casket 102 is larger than at least portions of the heatable body 106. The components may be designed so that the void space 114 is located along the entire top, sides or bottom of the heatable body 106 or just along portions of the top, sides, or bottom of the heatable body. In this case, void spaces 114 are formed between the crucible 106A and the top plate 122, surrounding wall 120 and insert 124. Additionally, a void space is located between the exterior side surface of the mold 106B and the inside surface of the insert 124. The design of the void space 114 may be changed in order to accommodate design, size, safety, and other considerations. However, as noted above, maximizing the surface area of the heatable body 106 that is exposed to the fluid flow path 108 will improve heat transfer efficiency and is generally desirable in most cases.

While the fluid directing structures 114 are described above as void spaces 114, it should be understood that the fluid directing structure may take many different forms. In certain embodiments, the fluid directing structure is in the form of grooves or ridges 112 that extend into or away from the casket 102. The fluid may flow within the channels and grooves or may flow between the ridges. The grooves or ridges 112 may be arranged in a number of configurations (e.g., linear, non-linear, etc.), to maximize efficiency of cooling and heating or based on the size or shape of the casket 102 or heatable body 106. This type of fluid directing structure may be particularly useful when located in the base plate 110 beneath the heatable body 106 because it enables the heatable body 106 to be placed onto the base plate 110 while, at the same time, allowing the fluid to flow below the heatable body through grooves located in the baseplate.

Thus, after entering the heatable body 106, the fluid flows along the flow path 108 via the void spaces 114 and the grooves 112. Specifically, in the embodiment of FIG. 4, the fluid first flows outwards from the inlet 116A, 116B via the void 114 formed between the top of the crucible 106A and bottom of the top plate 122. The fluid then flows downwards in the void space 114 formed between the outer surface of the crucible 106A and the inner surface of the surrounding wall 120. The fluid then flows downwards in the void space 114 formed between the inner surface of the insert 124 and the outer surface of the mold 106B. Finally, the fluid flows inwards towards the outlet 118 in grooves 112 formed in the base plate 110 below the bottom of the heatable body 106.

Figure 5:
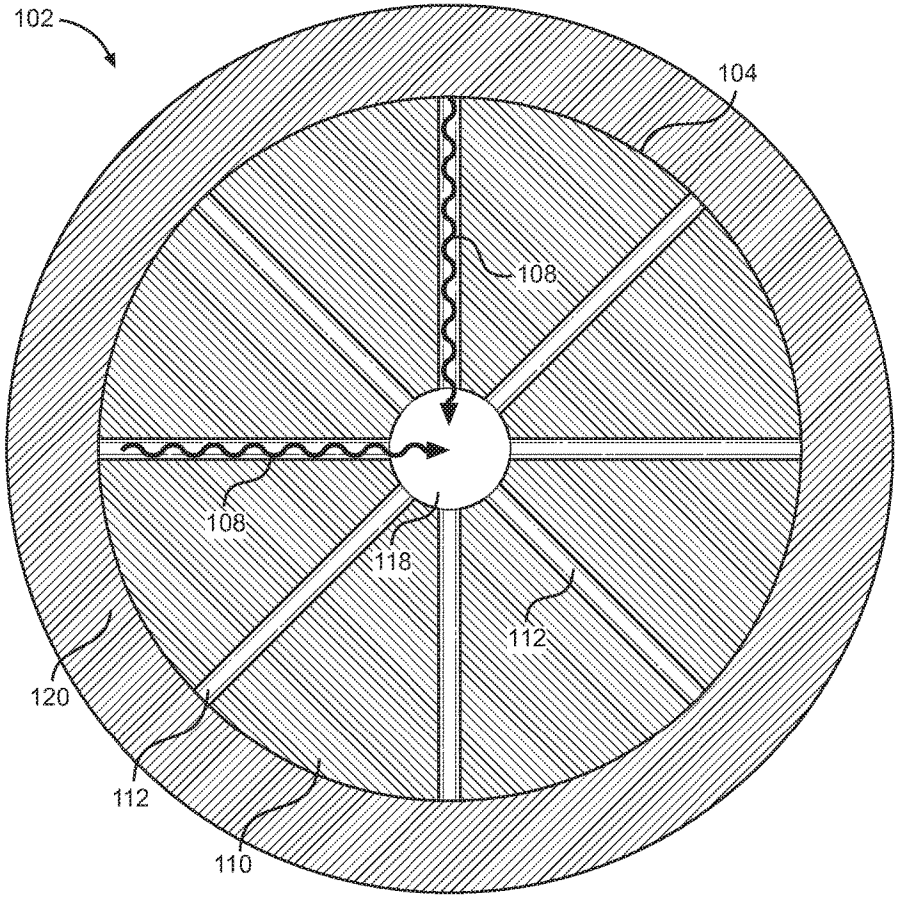
FIG. 5 is a cross sectional view shown along line 5-5 of FIG. 4 illustrating a base plate of the casket and a thermal transfer fluid flowing through radiating channels formed in the baseplate and out through a centrally disposed outlet formed therein according to one embodiment of the present disclosure.
Figure 6:
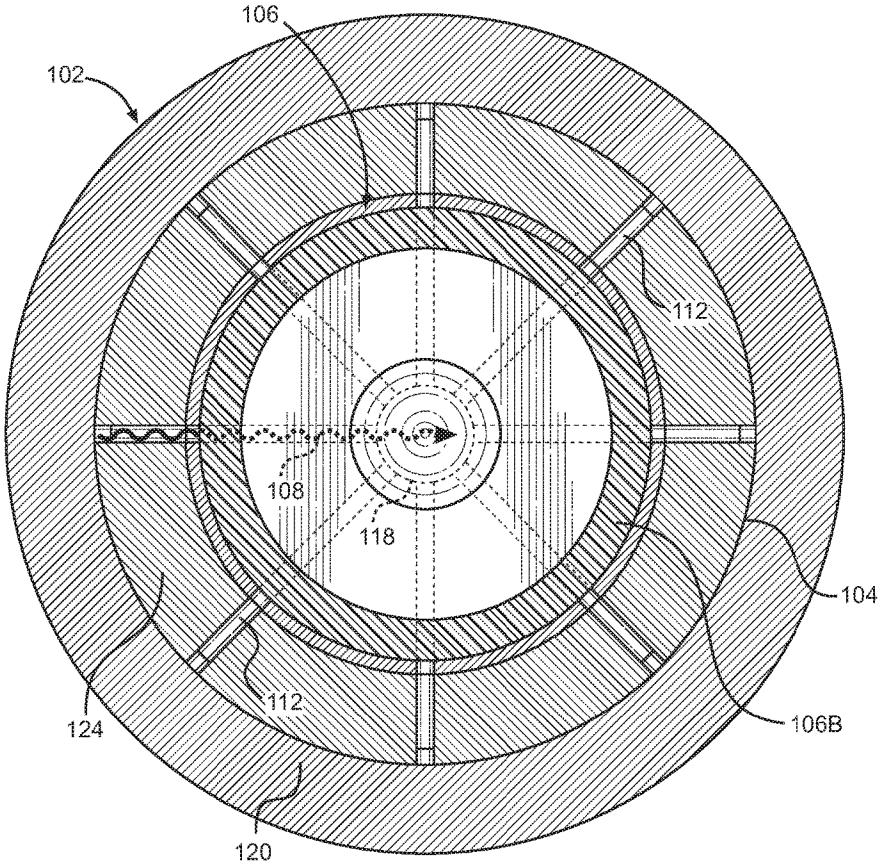
FIG. 6 is a cross sectional view shown along line 6-6 of FIG. 4 illustrating a first portion of a heatable body positioned on the baseplate within a cavity of the casket such that a void space is formed between the inner surface of the stack and the outer surface of the heatable body according to one embodiment of the present disclosure.
Figure 7:
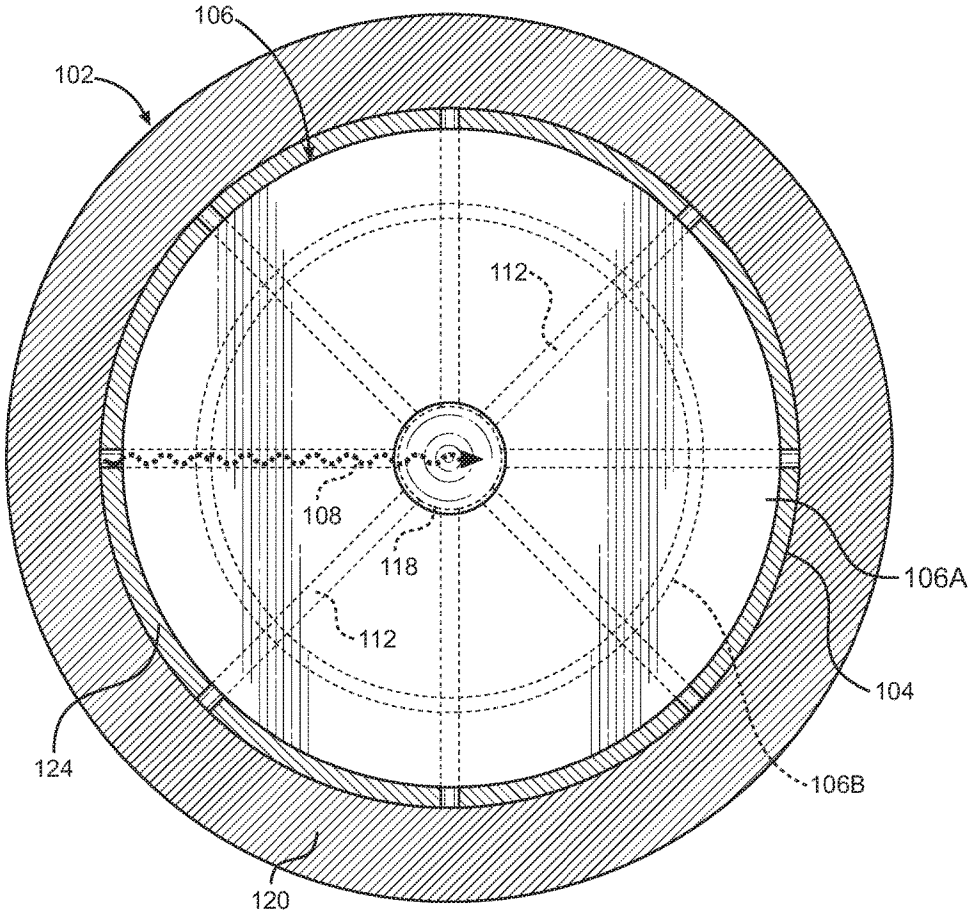
FIG. 7 is a cross sectional view shown along line 7-7 of FIG. 4 illustrating a second portion of the heatable body positioned within the cavity such that a void space is formed between the inner surface of the stack and the outer surface of the heatable body according to one embodiment of the present disclosure.

In FIG. 5, a cross section of the casting stack 102 taken along line 5-5 in FIG. 4 is provided that illustrates a portion of the flow path 108 described above. This cross-sectional view illustrates the final section of the flow path 108 described above where fluid directing structures (i.e., linear grooves 112) radiate away from the outlet 118. The fluid flows along this section of the flow path 108 via these grooves 112 and out of the outlet 118. FIG. 6 is a cross section of the casting stack 102 of FIG. 4 taken along line 6-6 just above the top surface of the inserts 124. This view illustrates the flow path 108 across the top of the insert 124, then between the inner surface of the insert and the outer surface of the mold 106B, and then below the mold to the outlet 118. Lastly, FIG. 7 is a cross section of the casting stack 102 of FIG. 4 taken along line 7-7 just above the top surface of the crucible 106A. This view illustrates the flow path 108 extending downwards in the void space 114 formed between the outer surface of the crucible 106A and the inner surface of the surrounding wall 120. The flow path 108 then continues downwards and out through the outlet 118, as discussed previously.

In summary, the method and apparatus disclosed herein enable control of heat and fluid flow into and out of a microwave chamber 201 and microwave casket 102. The thermal transfer fluid may flow in either direction along a flow path 108 that extends through the casket 102. In other cases, the flow path may be bypassed altogether. The casket 102 has a number of fluid directing structures, including grooves (or ridges) 112 and void spaces 114 that allow for circulation of a thermal transfer fluid to speed up cooling or heating. In certain cases, a first portion of the heatable body 106 may have a first susceptance level and a second portion of the heatable body 106 may have a second susceptance level. Placing that heatable body 106 into a microwave field could result in the first and second portions heating at different rates. Based on the materials' susceptance levels, the first portion might heat slightly faster or slightly slower than the second portion or the first portion might heat much faster or much slower than the second portion. The method and apparatus described herein enable thermal control of those components, which allows the ideal temperature gradient to be achieved more quickly and with less wasted energy or resources than previous methods and apparatus. While the method and apparatus discussed above are in reference to microwave casting furnace applications, a similar method or apparatus may also be used in connection with other casting methods that are carried out at ambient pressure or with an atmosphere, including and without limitation, induction heating. By flowing a thermal transfer fluid through a flow path that is at least partially adjacent a heatable body located within an induction furnace, a similar redistribution of heat is possible.

The foregoing description of embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A microwave furnace comprising:

a microwave casket having an inner surface forming an internal cavity, the microwave casket formed at least in part of a microwave transparent material;

a heatable body having an internal surface and an external surface disposed in the internal cavity of the casket configured for receiving a metal charge, the heatable body formed at least in part of a microwave susceptor material operable to heat in response to a microwave field for transferring the heat to the metal charge; and a thermal control system including a fluid flow path disposed between the inner surface of the microwave casket and the external surface of the heatable body, the fluid flow path fluidly connected at a first end to an inlet formed in the microwave casket and at a second end to an outlet formed in the microwave casket, the thermal control system operable to flow a thermal transfer fluid through the fluid flow path via the inlet to absorb heat from the heatable body and to transfer the absorbed heat along the fluid flow path until the thermal transfer fluid exits the fluid flow path via the outlet.

2. The microwave furnace of claim 1 further comprising:

a microwave chamber wall forming an enclosed microwave chamber, wherein the microwave casket and heatable body are disposed within the microwave chamber;

a fluid supply for supplying the thermal transfer fluid to the microwave chamber;

a first fluid pipe located outside of the microwave chamber having an end attached to the fluid supply and an opposite end in fluid communication with the microwave chamber, the first fluid pipe operable to carry the thermal transfer fluid from the fluid supply to the microwave chamber; and a second fluid pipe located outside of the microwave chamber and having an end in fluid communication with the microwave chamber and a fluid exhaust located at an opposite end of the second fluid pipe, the second fluid pipe operable to carry at least a portion of the thermal transfer fluid away from the microwave chamber, wherein, in response to a pressure differential between pressure inside the microwave chamber and pressure outside of the microwave chamber created by opening the first fluid pipe and the second fluid pipe, the thermal transfer fluid provided by the fluid supply via the first fluid pipe flows into the casket, flows along the flow path, flows out of the casket, and flows out of the microwave chamber via the second pipe.

3. The microwave furnace of claim 2 further comprising a pump disposed within the microwave chamber proximate the inlet of the flow path configured to intake and then propel thermal transfer fluid located within the microwave chamber through the flow path and to cause at least a portion of the fluid exiting the flow path to be re-circulated within the microwave chamber back to the pump and then propelled through the flow path.

4. The microwave furnace of claim 2, wherein the opposite end of the second fluid pipe is connected to the fluid supply such that fluid flowing through the flow path and exiting the microwave chamber via the second fluid pipe re-circulates back to the fluid supply, the microwave furnace further comprising a pump disposed in at least one of the first and second fluid pipes operable to cause the thermal transfer fluid to be propelled away from the fluid supply and into the microwave chamber via the first pipe, along the flow path, and out of the chamber and back to the fluid supply via the second pipe.

5. The microwave furnace of claim 1 wherein the fluid flow path is positioned between the microwave casket and the heatable body such that heat absorbed from a first portion of the heatable body by the thermal transfer fluid is used to heat a second portion of the heatable body as the thermal transfer fluid flows along the fluid flow path.

6. The microwave furnace of claim 5 wherein the first portion of the heatable body is formed of a first material that has a first susceptance level and wherein the second portion of the heatable body is formed of a second material that has a second susceptance level that is different from the first susceptance level.

7. The microwave furnace of claim 1 wherein the heatable body comprises a crucible and a mold.

8. The microwave furnace of claim 1 wherein the inlet is disposed in a top plate of the casket above the heatable body and wherein the outlet is disposed in a bottom plate of the casket below the heatable body.

9. The microwave furnace of claim 1 wherein the outlet is disposed in a top plate of the casket above the heatable body and wherein the inlet is disposed in a bottom plate of the casket below the heatable body.

10. The microwave furnace of claim 1 wherein the heatable body is placed on top of a base plate of the casket and wherein the fluid flow path comprises a fluid directing structure configured for directing the transfer fluid flowing across a surface of the base plate beneath at least a portion of the heatable body.

11. The microwave furnace of claim 10 wherein the fluid directing structure is selected from the group consisting of: one or more channels formed in the base plate and one or more ridges formed on the base plate.

12. The microwave furnace of claim 10 wherein the fluid directing structure extends radially outwards from a center of the base plate located directly beneath the heatable body.

13. The microwave furnace of claim 1 wherein the fluid flow path comprises a void space disposed between the inner surface of the microwave casket and the external surface of the heatable body.

14. The microwave furnace of claim 1 further comprising:

a microwave chamber wall forming an enclosed microwave chamber, wherein the microwave casket and heatable body are disposed within the microwave chamber;

a pump disposed within the microwave chamber proximate the inlet of the flow path configured to intake and then propel thermal transfer fluid located within the microwave chamber through the flow path and to cause at least a portion of the fluid exiting the flow path to be re-circulated within the microwave chamber back to the pump and then propelled through the flow path.

15. A method of thermal control of microwave furnace components, the method comprising the steps of:

providing a microwave casket having an inner surface forming an internal cavity, the microwave casket formed at least in part of a microwave transparent material;

providing a heatable body having an internal surface and an external surface in the internal cavity of the casket configured for receiving a metal charge, the heatable body formed at least in part of a microwave susceptor material operable to heat in response to a microwave field;

providing a thermal control system including a fluid flow path disposed between the inner surface of the microwave casket and the external surface of the heatable body, the fluid flow path fluidly connected at a first end to an inlet formed in the microwave casket and at a second end to an outlet formed in the microwave casket;

positioning the metal charge in the heatable body;

generating a microwave field to heat the microwave susceptor material of the heatable body for transferring heat to the metal charge; and introducing a thermal transfer fluid into the fluid flow path via the inlet, the thermal transfer fluid being operable to flow through the fluid flow path to absorb heat from the heatable body and to transfer the absorbed heat along the fluid flow path until the thermal transfer fluid exits the fluid flow path via the outlet.

16. The method of claim 15 further comprising the steps of:

providing a microwave chamber wall forming an enclosed microwave chamber, the microwave casket and heatable body being disposed within the microwave chamber, and wherein the thermal control system further includes:

a fluid supply for supplying the thermal transfer fluid to the microwave chamber, a first fluid pipe located outside of the microwave chamber having an end attached to the fluid supply and an opposite end in fluid communication with the microwave chamber, the first fluid pipe operable to carry the thermal transfer fluid from the fluid supply to the microwave chamber, and a second fluid pipe located outside of the microwave chamber and having an end in fluid communication with the microwave chamber and a fluid exhaust located at an opposite end of the second fluid pipe, the second fluid pipe operable to carry the thermal transfer fluid away from the microwave chamber, and in response to a pressure differential between pressure inside the microwave chamber and pressure outside the microwave chamber caused by opening the first fluid pipe and the second fluid pipe, carrying the thermal transfer fluid from the fluid supply to the microwave chamber via the first fluid pipe such that the thermal transfer fluid flows into the casket, flows along the flow path, and flows out of the microwave chamber via the second fluid pipe.

17. The method of claim 16 further comprising the steps of:

providing a pump within the microwave chamber proximate the inlet of the flow path;

intaking and then propelling thermal transfer fluid located within the microwave chamber through the flow path with the pump; and re-circulating at least a portion of the fluid exiting the flow path within the microwave chamber by intaking and then propelling the at least a portion through the flow path with the pump.

18. The method of claim 16 further wherein the opposite end of the second fluid pipe is connected to the fluid supply such that the thermal transfer fluid flowing through the flow path and exiting the microwave chamber via the second fluid pipe re-circulates back to the fluid supply, and the method further comprising the steps of:

providing a pump disposed in at least one of the first and second fluid pipes, wherein the pump propels the thermal transfer fluid away from the fluid supply and into the microwave chamber via the first pipe, along the flow path, and out of the chamber and back to the fluid supply via the second pipe.

19. The method of claim 15 wherein heat absorbed heat from a first portion of the heatable body is transferred to and heats a second portion of the heatable body as the thermal transfer fluid flows along the fluid flow path.

20. The method of claim 19 wherein the first portion of the heatable body is formed of a first material that has a first susceptance level and wherein the second portion of the heatable body is formed of a second material that has a second susceptance level that is different from the first susceptance level.

21. The method of claim 15 wherein the heatable body comprises a crucible and a mold.

22. The method of claim 15 wherein the heatable body is placed on top of a base plate of the casket and wherein the fluid flow path comprises a fluid directing structure configured for directing transfer fluid flowing across a surface of the base plate beneath at least a portion of the heatable body.

23. The method of claim 22 wherein the fluid directing structure is selected from the group consisting of: one or more channels formed in the base plate and one or more ridges formed on the base plate.

24. The method of claim 15 wherein the inlet is disposed in a top plate of the casket above the heatable body and wherein the outlet is disposed in a bottom plate of the casket below the heatable body.

25. The method of claim 15 wherein the outlet is disposed in a top plate of the casket above the heatable body and wherein the inlet is disposed in a bottom plate of the casket below the heatable body.

26. The method of claim 15 further comprising the steps of:

providing a microwave chamber wall to form an enclosed microwave chamber, wherein the microwave casket and heatable body are disposed within the microwave chamber;

providing a pump within the microwave chamber proximate the inlet of the flow path;

intaking and then propelling thermal transfer fluid located within the microwave chamber through the flow path with the pump; and re-circulating at least a portion of the fluid exiting the flow path within the microwave chamber by intaking and then propelling the at least a portion through the flow path with the pump.

27. The microwave furnace of claim 1 wherein the thermal control system includes a pump for recirculating at least a portion of the thermal transfer fluid exiting the fluid flow path back through the fluid flow path and a vent for releasing off-gases out of the thermal control system.

28. A microwave furnace comprising:

a microwave casket having an inner surface forming an internal cavity, the microwave casket formed at least in part of a microwave transparent material;

a heatable body disposed in the internal cavity of the casket having a crucible and a mold each formed at least in part of a microwave susceptor material such that the crucible is operable to heat in response to a microwave field to form molten metal from a metal charge positioned within the crucible and the mold is operable to heat in response to the microwave field for maintaining heat to the molten metal as the molten metal flows to the mold from the crucible; and a thermal control system including a fluid flow path disposed between the microwave casket and the heatable body along an exterior surface of both the crucible and the mold, the thermal control system operable to flow a thermal transfer fluid through the fluid flow path in at least one of a first direction to absorb heat from the crucible and transfer the absorbed heat along the fluid flow path to the mold and a second direction to absorb heat from the mold and transfer the absorbed heat along the fluid flow path to the crucible.

29. The microwave furnace of claim 28 wherein the crucible is formed at least in part of a first microwave susceptor material that has a first susceptance level and the mold is formed at least in part of a second microwave susceptor material that has a second susceptance level that is different from the first susceptance level.

30. The microwave furnace of claim 28 wherein the thermal control system is operable to selectively flow the thermal transfer fluid in both the first direction and the second direction.

* * * * *